US011204177B2

(12) United States Patent
Hess et al.

(10) Patent No.: US 11,204,177 B2
(45) Date of Patent: Dec. 21, 2021

(54) EXHAUST FAN FOR A COMMERCIAL KITCHEN

(71) Applicant: Captive-Aire Systems, Inc., Raleigh, NC (US)

(72) Inventors: Joshua J. Hess, Washington Boro, PA (US); Patrick E. McElrone, Reading, PA (US)

(73) Assignee: Captive-Aire Systems, Inc., Raleigh, NC (US)

( * ) Notice: Subject to any disclaimer, the term of this patent is extended or adjusted under 35 U.S.C. 154(b) by 105 days.

(21) Appl. No.: 16/795,888

(22) Filed: Feb. 20, 2020

(65) Prior Publication Data

US 2021/0262673 A1 Aug. 26, 2021

(51) Int. Cl.
*F24C 15/20* (2006.01)

(52) U.S. Cl.
CPC ..... *F24C 15/20* (2013.01)

(58) Field of Classification Search
CPC ..... F24C 15/20; F24F 3/163; F04D 25/082
USPC ..... 126/299 R; 454/56–57, 66–67
See application file for complete search history.

(56) References Cited

U.S. PATENT DOCUMENTS

| | | | | |
|---|---|---|---|---|
| 3,117,770 | A * | 1/1964 | Cromb | F04D 25/082 432/222 |
| 10,731,281 | B2 * | 8/2020 | Chan | D05B 71/00 |
| 2007/0202795 | A1 | 8/2007 | Seliger et al. | |
| 2013/0011239 | A1 | 1/2013 | Khalitov et al. | |
| 2013/0101402 | A1 * | 4/2013 | Rosen | F04D 29/584 415/180 |
| 2013/0180220 | A1 * | 7/2013 | McAuliffe | B64D 13/00 55/385.2 |
| 2018/0135651 | A1 | 5/2018 | Howe | |
| 2019/0027996 | A1 * | 1/2019 | Lang | H02K 17/16 |

FOREIGN PATENT DOCUMENTS

EP 3524823 A1 8/2019

* cited by examiner

*Primary Examiner* — Vivek K Shirsat
*Assistant Examiner* — Ko-Wei Lin
(74) *Attorney, Agent, or Firm* — Coats & Bennett, PLLC

(57) ABSTRACT

An exhaust system for exhausting air from appliances in a commercial kitchen is described. The exhaust system comprises an exhaust fan that includes a housing, a motor mounted in the housing, and a fan directly driven by the motor. A motor compartment surrounds the motor. Cooling air is induced into and through the housing and directed into the motor compartment for cooling the motor. Cooling air is discharged from a motor compartment and mixed with exhaust air to form an air mixture that is directed through the housing of the exhaust fan.

11 Claims, 3 Drawing Sheets

EXHAUST FAN FOR A COMMERCIAL KITCHEN

FIELD OF THE INVENTION

The present invention relates to exhaust systems and more particularly to exhaust systems designed to exhaust air from commercial kitchen appliances, such as kitchen hoods.

BACKGROUND OF THE INVENTION

Commercial kitchens are typically equipped with an exhaust system for exhausting air from appliances, such as kitchen hoods and dishwashers. In the case of a kitchen hood, for example, the air exhausted therefrom is typically laden with grease and is of a relatively high temperature, sometimes approaching 300° F. Typically, exhaust systems include a fan driven by a motor. These typically lie in the exhaust air stream being directed from the kitchen appliances to a point outside of the building containing the kitchen. Here the motor is asked to perform in a hot environment. This hot environment impacts the performance and life of the motor which in turn results in the motor requiring replacement too often and also contributes to increased maintenance cost.

Hence, there is a need for a commercial kitchen exhaust system designed to minimize heat buildup in and around the motor. Further, there is a need to incorporate into the exhaust system features that positively cool the motor when the exhaust system is operating.

SUMMARY OF THE INVENTION

The present invention relates to an exhaust fan for exhausting air from an appliance in a commercial kitchen. The exhaust fan includes a motor for driving a fan. A motor compartment at least partially encloses the motor. To cool the motor when the exhaust system is operating, cooling air is induced into and through the motor compartment and in the process the cooling air cools the motor. Cooling air in the motor compartment is directed into what is termed a cooling air snorkel that extends from the motor compartment and around the fan to where the snorkel includes a terminal end that discharges the cooling air adjacent the low pressure side of the fan. Hence, the cooling air discharged by the snorkel is mixed with exhaust air to form an air mixture and the air mixture is exhausted through a housing containing the motor, motor compartment and fan.

The present invention in one embodiment also comprises a method or process for cooling the motor of an exhaust fan incorporated into a commercial kitchen. The exhaust fan includes a motor for driving a fan and there is provided a motor compartment that at least partially encases the motor. The method or process for cooling the motor includes inducing cooling air into cooling air inlets formed in the side walls of a housing that contains the motor and fan. From the cooling air inlets, the method or process entails directing the cooling air through one or more conduits or tubes into the motor compartment where the cooling air passes in and around the motor and in the process cools the same. Thereafter, at least some of the cooling air in the motor compartment is directed through the snorkel that extends from the motor compartment and around the fan. The snorkel includes a terminal end that is located on the low pressure side of the fan. Cooling air discharged from this terminal end is mixed with the exhaust air to form an air mixture that is exhausted through the housing containing the fan, motor and motor compartment.

The open terminal end of the cooling air snorkel is located in a low pressure zone adjacent the inlet end of the fan. In this method or process, it is the low pressure zone that induces cooling air to enter the housing and flow around the motor in the motor compartment and to flow out the cooling air snorkel. Effectively, the cooling air is drawn into the motor compartment due to the low pressure zone existing on the inlet side of the fan.

In some embodiments, all or substantially all of the cooling air is discharged through the snorkel. In other cases, only a part of the cooling air in the motor compartment is discharged via the snorkel. Here a portion of the cooling air in the motor compartment is exhausted through a front motor plate disposed between the motor and the fan. This cooling air is also mixed with the exhaust air.

Other objects and advantages of the present invention will become apparent and obvious from a study of the following description and the accompanying drawings which are merely illustrative of such invention.

DESCRIPTION OF EXEMPLARY EMBODIMENTS

Figure 1:
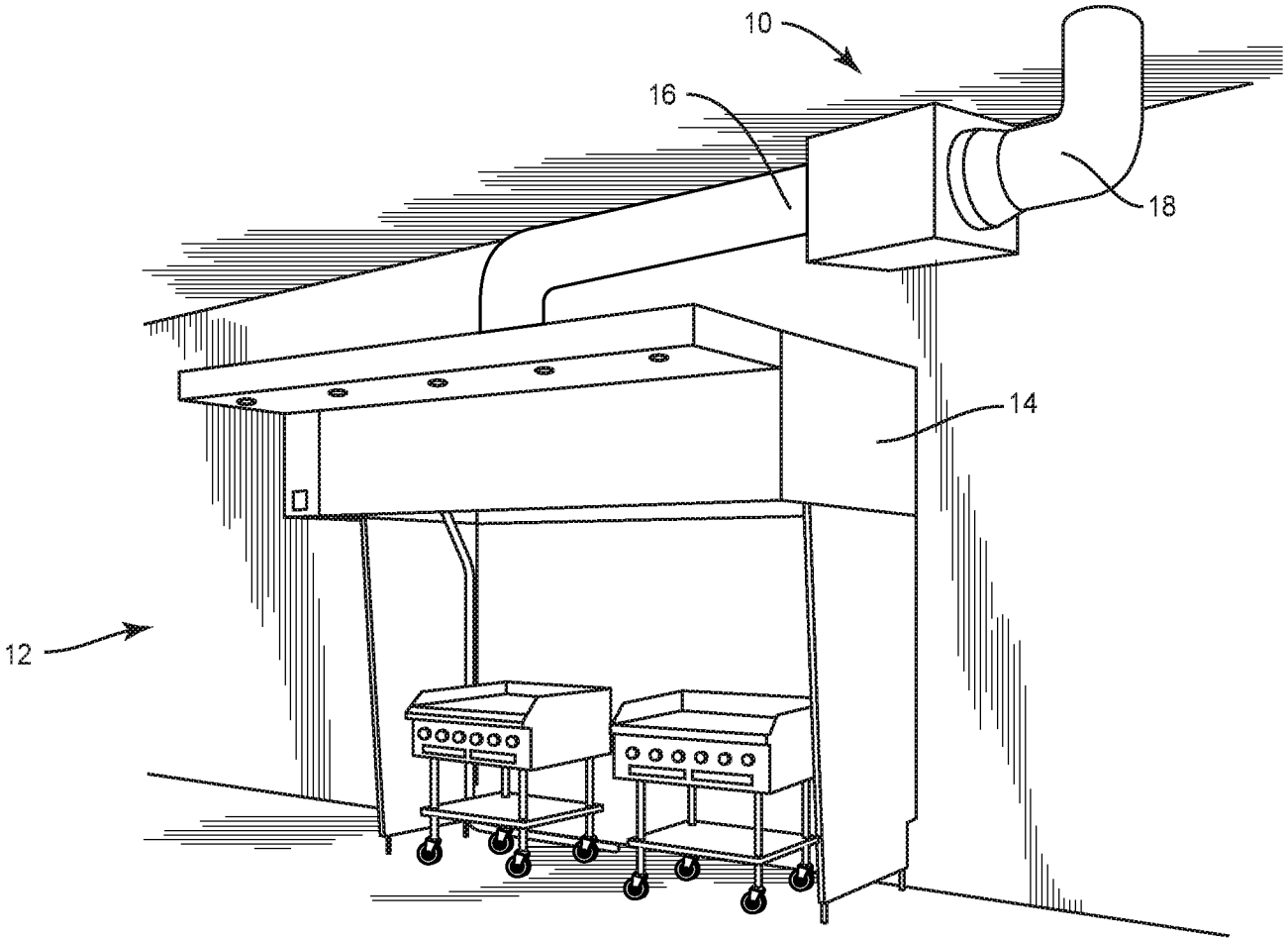
FIG. 1 is a schematic illustration of a commercial kitchen having the exhaust fan incorporated into an air exhaust system for exhausting air from the commercial kitchen.

With further reference to the drawings, an exhaust fan is shown therein and indicated generally by the numeral 10. As will be discussed in more detail below, the exhaust fan 10 is provided with a cooling system for cooling an electric motor which forms a part of the exhaust fan.

Exhaust fan 10 is particularly adapted to exhaust air from a commercial kitchen indicated generally by the numeral 12. See FIG. 1. Commercial kitchen 12 includes one or more appliances served by an exhaust system that exhausts air from the commercial kitchen. In the embodiment illustrated here, the commercial kitchen includes a kitchen hood 14 that is disposed over cooking surfaces. Exhaust air is pulled over cooking surfaces and through the kitchen hood 14 by the exhaust fan 10 and ultimately exhausted from the building housing the commercial kitchen. Details of the kitchen hood 14 are not dealt with herein because kitchen hood designs are well known and appreciated by those skilled in the art. For a more complete understanding of kitchen hoods and their designs, one is referred to U.S. Pat. Nos. 7,963,382 and 8,378,834, the disclosures of which are expressly incorporated herein by reference.

There are various ways the exhaust fan 10 can be incorporated into a system for exhausting air from kitchen hood 14. FIG. 1, in a simplified fashion, schematically illustrates one example. Exhaust air pulled over the cooking surfaces is induced upwardly through the kitchen hood 14 and into a first duct 16. The first duct 16 is operatively connected between the kitchen hood 14 and the exhaust fan 10. A second duct 18 is operatively connected to the downstream end of the exhaust fan 10 and in the case of this example includes an elbow that enables a portion of the duct to extend through the roof of a building housing the commercial kitchen where exhaust air is exhausted.

Figure 2:
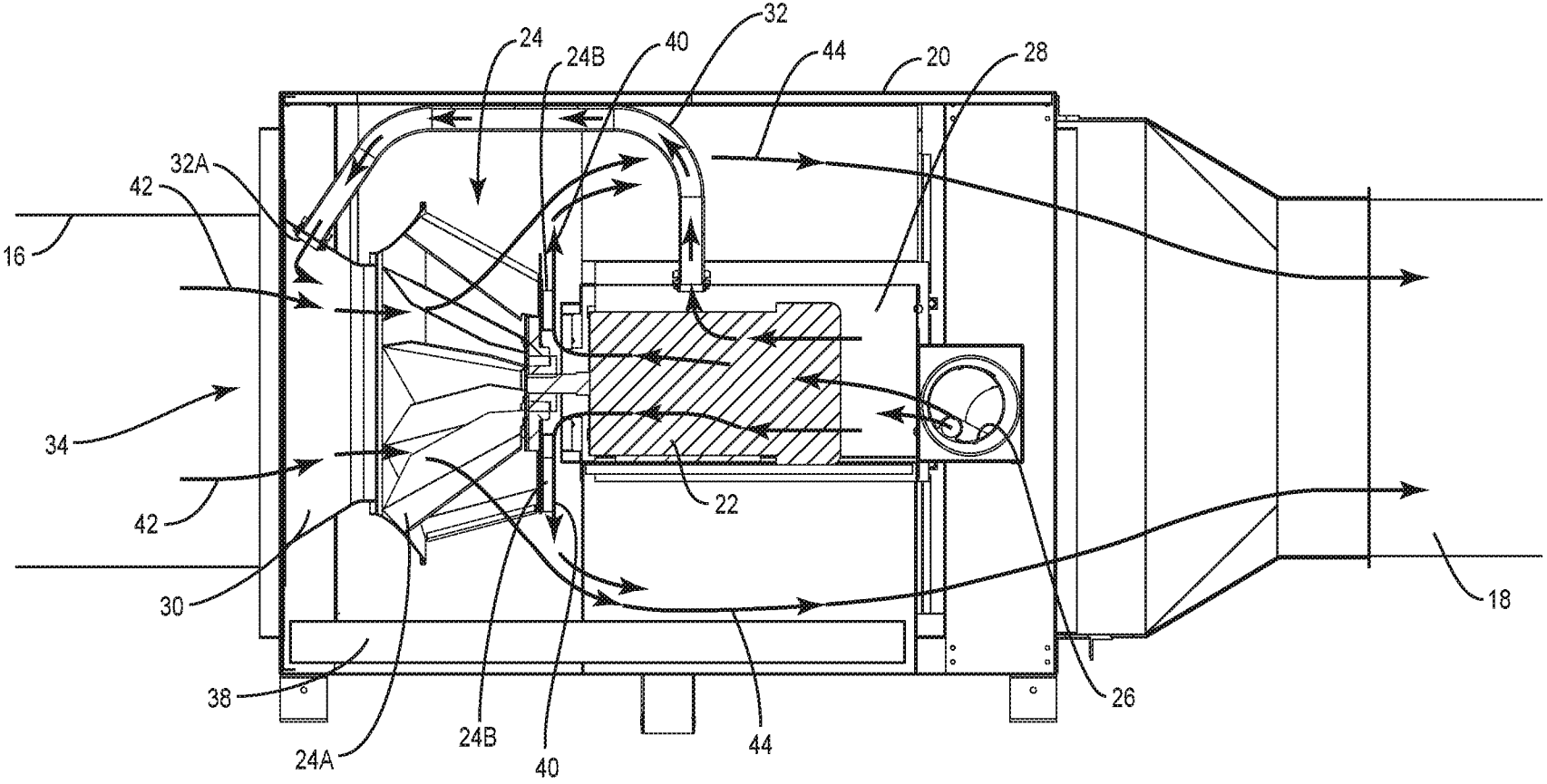
FIG. 2 is a side elevational view of the exhaust fan with a side panel being removed to better illustrate the internal components of the exhaust fan.
Figure 3:
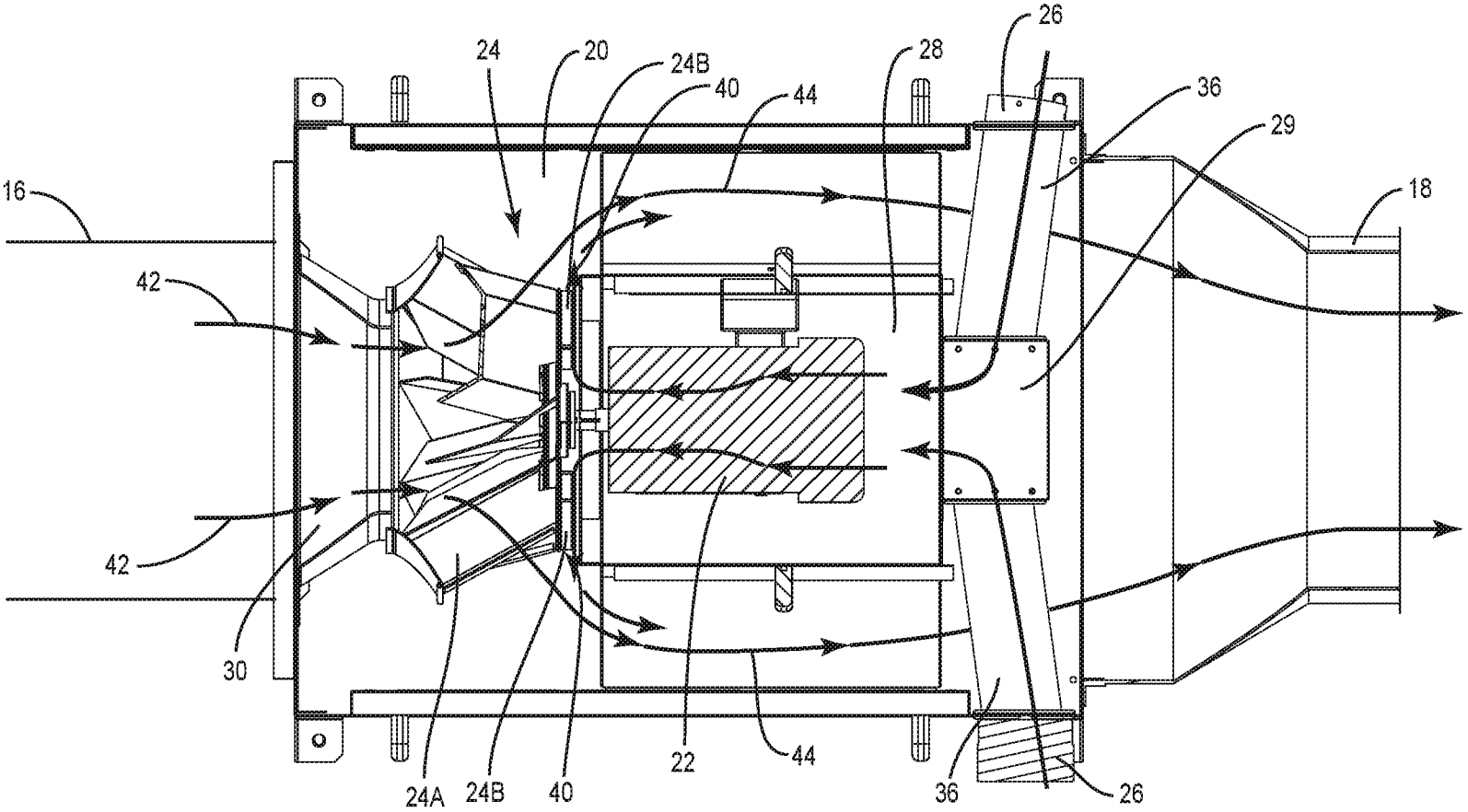
FIG. 3 is a view similar to FIG. 2 but rotated 90° and where another side panel is removed to illustrate the internal components of the exhaust fan.

Now turning to the exhaust fan 10 as seen in FIGS. 2 and 3, the exhaust fan includes a housing 20. In the case of the embodiment illustrated herein, the housing includes a top, bottom and a pair of sides with the opposite ends being generally open to permit air to pass there through. A motor 22 is mounted in the housing 20. A fan 24 is operatively connected to the motor and driven thereby. In the case of the embodiment illustrated here, fan 24 is a direct drive fan. It is understood and appreciated, however, by those skilled in the art that some embodiment might include an indirect driven fan. Also, the term "fan" should be construed broadly to include any fan or device for moving air through the housing 20. In the case of the embodiment illustrated herein, fan 24 is generally referred to as a wheel fan. It includes primary blades 24A and secondary blades 24B.

A motor compartment 28 at least partially encloses or encases the motor 22. Motor compartment 28 functions to protect the motor from grease-laden exhaust air that passes through the housing 20 and at the same time, as illustrated below, facilitates the cooling of the motor 22 during operation. As explained below, the exhaust fan is designed to induce cooling air into the housing and into the motor compartment and over and around the motor 22 to cool the same.

In this regard, the housing is provided with one or more cooling air inlets 26. The function of the cooling air inlets 26 is to enable air outside of the housing 20 to enter the housing for purposes of cooling the motor 22. Each cooling air inlet 26 is operatively connected to a conduit or tube 36. See FIG. 3. Cooling air conduits 36 are operatively connected to the cooling air inlets 26 and extend therefrom towards the motor compartment 28. The cooling air conduits 36 can be directly coupled to the motor compartment 28 or can be joined to a manifold 29 that in turn is connected to the motor compartment 28. See FIG. 3. In any event, cooling air conduits 36 are designed to channel cooling air from the cooling air inlets 26 into the motor compartment 28. Once in the motor compartment, the cooling air circulates in and around the motor 22 and cools the same in the process.

Operatively connected to the motor compartment 28 is what is referred to as a cooling air snorkel 32. See FIG. 2. The function of the cooling air snorkel 32 is to discharge at least some of the cooling air from the motor compartment. More particularly, cooling air in the motor compartment 28 is induced into the cooling air snorkel 32 and exhausted out a terminal end thereof. Note that the cooling air snorkel 32 tends to bow or curve around the fan 24 and in this case, the terminal end 32A of the snorkel is connected to a Venturi or exhaust air inlet 30 that is disposed in the inlet end of the exhaust fan 10. The term "cooling air snorkel" means a tube or conduit that is designed to extend between the motor compartment and the low pressure side of the fan 24 for the purpose of channeling cooling air from the motor compartment to the low pressure side of the exhaust fan.

A low pressure zone or area 34 is formed on the inlet side of the fan 24. This low pressure zone 34 serves to induce cooling air into the motor compartment 28. That is, in this embodiment, the low pressure zone 34 is disposed at least partially within the confines of the Venturi 30 and as such the terminal end 32A of the cooling air snorkel 32 is open to this low pressure zone. Because of the presence of the low pressure zone, cooling air is induced to move into and through the cooling air inlets 26 and through the cooling air conduits 36 into the motor compartment 28 and from the motor compartment through the cooling air snorkel 32 to where the cooling air is exhausted on the low pressure side of the fan 24.

Disposed between the motor 22 and fan 24 is a plate referred to as a front motor plate. The front motor plate is also disposed between the motor compartment 28 and the fan 24. However, the motor plate includes openings that are open to the motor compartment 28. Hence, cooling air in the motor compartment 28 can flow out through the openings in the motor plate. When the fan 24 is driven, its secondary blades 24B (see FIGS. 2 and 3) induces cooling air from the motor compartment 28 through the openings in the motor plate and generally outwardly. In FIGS. 2 and 3, this cooling air, i.e. the cooling air induced by the secondary blades 24B to flow from the motor compartment 28 through the motor plate, is referenced by arrows 40. Thus, in some embodiments, cooling air is discharged from the motor compartment 28 through the snorkel 32, as well as through the openings in the motor plate.

Hence, when the exhaust fan 10 is operating, exhaust air (arrows 42) from the kitchen hood 14 enters the Venturi 30. Also, cooling air discharged from the snorkel 32 enters the Venturi 30. Further, in the embodiment illustrated, cooling air induced by the secondary blades 24B and passing through the motor plate enters the housing downstream of the Venturi 30. Note arrows 40 and FIGS. 2 and 3. The action of the fan 24 effectively mixes the exhaust air and the cooling air in the housing to form an air mixture, referred to by arrows 44. This air mixture is directed from left-to-right (as viewed in FIG. 2) through the housing and into the second duct 18 which is operative to directly or indirectly exhaust the air mixture from the building.

In the embodiment illustrated, the exhaust fan 10 is generally horizontally oriented. One reason for this is that the exhaust fan 10 includes a grease pan 38 (FIG. 2) in the bottom of the housing 20 that functions to catch and hold grease that is separated from the air mixture passing through the housing.

The term "configured to" has been used in the specification, including the claims. The term "configured to" is meant to mean "designed to".

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

What is claimed is:

1. An exhaust system configured to exhaust air from a commercial kitchen, comprising:

an exhaust fan comprising:

a housing;

a motor mounted in the housing;

a direct drive fan operatively connected to the motor and disposed on an air inlet end of the housing;

a motor compartment mounted in the housing and at least partially encasing the motor;

at least one cooling air inlet formed in the housing;

a conduit extending from one of the at least one cooling air inlet to the motor compartment and configured to direct cooling air from the one of the at least one cooling air inlet into the motor compartment where the cooling air cools the motor in the motor compartment;

a cooling air snorkel connected to the motor compartment and extending therefrom around the direct drive fan towards an air inlet end of the exhaust fan;

the cooling air snorkel having a terminal end that terminates upstream of the fan;

the cooling air snorkel configured to direct at least some of the cooling air from the motor compartment and to discharge the cooling air upstream of the direct drive fan;

wherein said direct drive fan is configured to induce the cooling air discharged from the cooling air snorkel into the direct drive fan and configured to mix the cooling air with exhaust air from the commercial kitchen to form an air mixture and configured to exhaust the air mixture over the motor compartment and out the housing; and wherein the exhaust system includes one or more ducts configured to operatively connect one or more appliances in the commercial kitchen with the exhaust fan.

2. The exhaust system of claim 1 wherein the cooling air snorkel is curved and forms a bow around the direct drive fan.

3. The exhaust system of claim 1 wherein the exhaust system includes a kitchen hood situated in the commercial kitchen and at least one of the one or more ducts connected between the hood and the air inlet end of the housing such that the exhaust air passing through the kitchen hood is directed through the duct and into the housing containing the motor and the direct drive fan.

4. The exhaust system of claim 1 wherein the direct drive fan includes both primary blades and secondary blades and wherein the secondary blades are disposed adjacent the motor compartment and are configured to induce at least some of the cooling air in the motor compartment into the housing where the cooling air is mixed with the exhaust air to form the air mixture.

5. The exhaust system of claim 4 further including a front motor plate disposed between the motor compartment and the direct drive fan and including one or more openings therein configured to permit cooling air to be discharged from the motor compartment through the motor plate.

6. The exhaust system of claim 1 wherein the exhaust fan is configured to force the mixture of exhaust air and cooling air horizontally through the housing; and wherein the exhaust fan includes a grease pan disposed on the bottom of the exhaust fan for receiving and holding grease.

7. The exhaust system of claim 1 wherein the terminal end of the cooling air snorkel and the direct drive fan are spaced with respect to each other and configured to induce cooling air into the cooling inlet and through the motor compartment, and through the cooling air snorkel.

8. A method of exhausting air from an appliance in a commercial kitchen with an exhaust system which includes a motor and a direct drive fan coupled to the motor and wherein the motor and direct drive fan are mounted within a housing, the method comprising:

driving the direct drive fan and inducing exhaust air to move from the appliance into an air inlet end of the housing;

driving the direct drive fan to create a low pressure zone adjacent the fan, and wherein the low pressure zone induces cooling air from outside of the housing to move through at least one cooling air inlet formed in the housing;

from the at least one cooling air inlet in the housing, directing the cooling air into a conduit disposed between the at least one cooling air inlet and a motor compartment that at least partially surrounds the motor;

cooling the motor by directing the cooling air into the motor compartment and around the motor therein;

directing at least some of the cooling air from the motor compartment into a cooling air snorkel;

directing the cooling air through the snorkel and discharging the cooling air from the snorkel upstream of the direct drive fan; and mixing the cooling air discharged from the snorkel with the exhaust air to form an air mixture and directing the air mixture through the fan and out the housing.

9. The method of claim 8 including discharging at least some of the cooling air in the motor compartment through openings in a motor plate disposed between the motor compartment and the fan.

10. The method of claim 8 wherein the fan includes primary and secondary blades and wherein the method includes driving the secondary blades and wherein the secondary blades induce at least some of the cooling air in the motor compartment to move through openings in a motor plate disposed between the motor compartment and the fan.

11. The method of claim 8 wherein the direct drive fan includes primary blades and secondary blades; wherein the method further includes driving the secondary blades to cause at least some of the cooling air in the motor compartment to be discharged therefrom.

* * * * *